United States Patent [19]

Hart et al.

[11] Patent Number: 5,020,343

[45] Date of Patent: Jun. 4, 1991

[54] LOCKSET HAVING IMPROVED ACTUATOR

[75] Inventors: LeRoy Hart, Farmington; Theodore H. Miller, deceased, late of New Britain, both of Conn., by Cecilia B. Miller, administratrix

[73] Assignee: Emhart Industries, Inc., Towson, Md.

[21] Appl. No.: 579,222

[22] Filed: Sep. 7, 1990

Related U.S. Application Data

[63] Continuation of Ser. No. 225,988, Jul. 29, 1988, abandoned.

[51] Int. Cl.[5] ..... E05B 55/06

[52] U.S. Cl. ..... 70/143; 70/380; 70/473; 70/477; 70/478; 292/166; 292/169.15

[58] Field of Search ..... 292/169, 169.15, 166, 292/DIG. 52; 70/475, 478, 469, 473, 474, 477, 210, 467, 153, 143, 380, 484, 485

[56] References Cited

U.S. PATENT DOCUMENTS

| | | | |
|---|---|---|---|
| 575,763 | 1/1897 | Wildern | 70/210 |
| 626,340 | 6/1899 | Phelps | 70/477 X |
| 945,276 | 1/1910 | Jenks | 292/169 X |
| 2,266,086 | 12/1941 | Schlage | 70/475 X |
| 2,357,551 | 9/1944 | Schlage | 70/475 |
| 2,505,188 | 4/1950 | Kaiser | 70/210 |
| 3,279,836 | 10/1966 | Swanson | 292/337 |
| 4,255,953 | 3/1981 | Dietrich et al. | 70/143 X |
| 4,333,324 | 6/1982 | Dietrich et al. | 70/143 X |
| 4,594,864 | 6/1986 | Hart | 70/143 |
| 4,741,190 | 5/1988 | Miller | 70/467 |
| 4,945,737 | 8/1990 | Hart | 70/474 X |

FOREIGN PATENT DOCUMENTS

| | | | |
|---|---|---|---|
| 0136891 | 4/1985 | European Pat. Off. | 70/143 |

*Primary Examiner*—Lloyd A. Gall

*Attorney, Agent, or Firm*—Barry E. Deutsch; J. Bruce Hoffnagle

[57] ABSTRACT

A lockset for a door comprising a latchbolt assembly movable between a partially extended latching position, a fully extended deadbolt position and a retracted position. A spindle extends through the latchbolt assembly in a direction transverse of the direction of movement of the bolt. The spindle is connected to the bolt for moving the bolt between its positions upon rotation of the spindle. An operating assembly includes a hand operator having a locking member therein, a first plate mounted for linear movement in a direction transverse to the axis of the spindle and having a pair of ears vertically spaced about and generally aligned with the longitudinal axis of the spindle. A pivotally mounted actuator member is movable in response to the hand operator and has first and second surfaces vertically spaced about and generally aligned with the longitudinal axis of the spindle and in engagement with the pair of ears such that pivotal movement of the actuator produces linear movement of the first plate.

13 Claims, 7 Drawing Sheets

FIG. 10
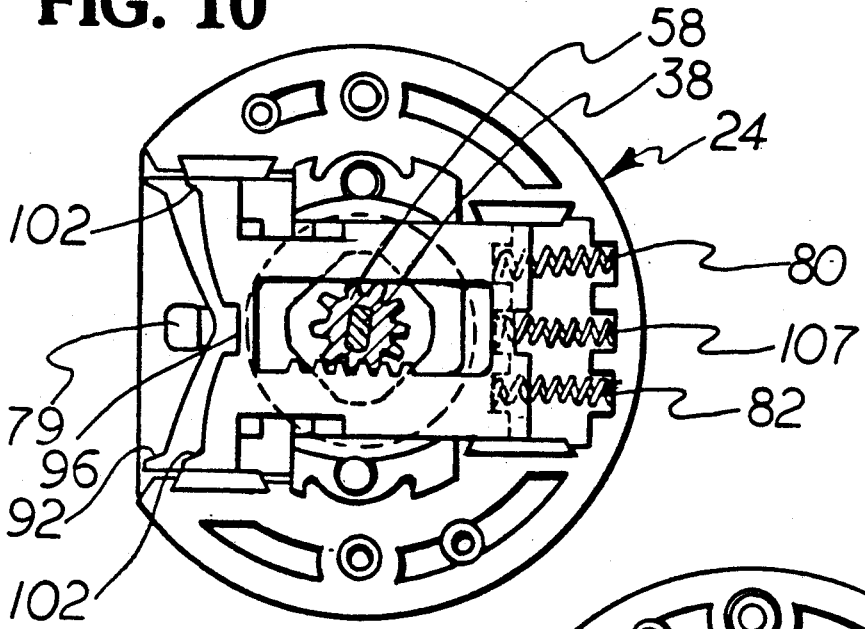
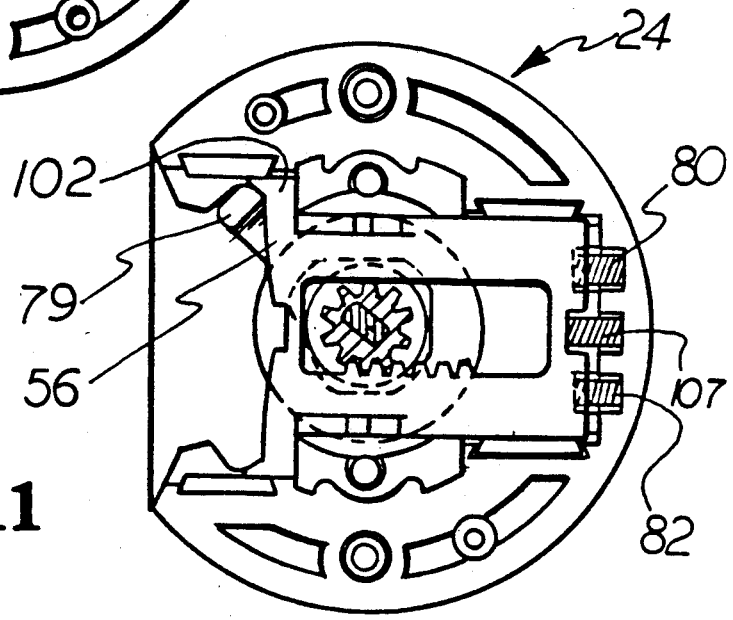
FIG. 11

LOCKSET HAVING IMPROVED ACTUATOR

This is a continuation of application Ser. No. 07/225,988, filed July 29, 1988, now abandoned.

BACKGROUND OF THE INVENTION

This invention relates in general to a lockset, and more particularly to a lockset having an improved actuator mechanism for moving the latch of the lockset in response to rotation of a hand operator.

In U.S. Pat. No. 4,594,864, there is disclosed a lockset having a single latch assembly capable of functioning as a latchbolt and a deadbolt. While the lockset disclosed in the '864 patent has enjoyed considerable commercial success, it has heretofore had one limitation, i.e., the lockset could only be used with a lever type hand operator. A lever type operator can develop a moment arm of a relatively larger magnitude when compared to the moment arm which can be developed by a knob type hand operator, assuming the identical rotational forces are applied to both types of operators. As the internal forces developed by the lockset are resistive of the moment arm generated through the hand operator and are of a somewhat large magnitude in the lockset under consideration, it has been necessary to use lever type operators to ensure that sufficient forces are available to achieve desired movement of the latch assembly.

There are many applications for which a knob type operator may be desired rather than a lever type operator. Since the torsional force developed to move the latch assembly of the lockset when a knob type operator is used is of a smaller magnitude when compared to the torsional force developed through use of a lever type operator, it has been found that the actuator used in the lockset disclosed in U.S. Pat. No. 4,594,864 generally cannot be used with a knob type operator.

In the actuator of the prior art, the force generated therefrom to move the latch assembly is applied radially outward relative to the longitudinal centerline of the lockset. If we consider the centerline to be a fulcrum, the torsional force developed by the hand operator is applied through the actuator to overcome the internal reactive forces of the lockset to move the latch assembly. As is apparent when the actuator force is applied radially outward relative to the fulcrum, the actual force available to overcome the reactive forces is dependent upon the radial distance. The magnitude of the available force is inversely proportional to the radius; that is, as the radial distance increases, the magnitude of the force decreases. To increase the available torsional force to move the latch, it is necessary to reduce the radial distance at which the force is applied by the actuator. By reducing such radial distance, the torsional force developed by the hand operator may be reduced in magnitude since proportionally more of such force will be available to move the latch assembly. It is therefore an object of the invention to provide an improved actuator for a lockset to enable a knob type hand operator to be used on the lockset.

SUMMARY OF THE INVENTION

The foregoing object and other objects of the invention are attained in a lockset for a door including a latchbolt assembly movable between a partially extended latching position, a fully extended deadbolt position and a retracted position; a spindle extending through the latchbolt assembly in a direction transverse of the direction of the movement of said bolt; means connecting said spindle to said bolt for moving said bolt between its positions upon rotation of said spindle; and a hand operator having locking means therein, a first plate mounted for linear movement in a direction transverse to the axis of said spindle and having a pair of ears vertically spaced about and generally aligned with the longitudinal axis of said spindle, a pivotally mounted actuator member movable in response to said hand operator and having first and second surfaces vertically spaced about and generally aligned with the longitudinal axis of said spindle and in engagement with the pair of ears, with pivotal movement of said actuator producing linear movement of said plate.

BRIEF DESCRIPTION OF THE DRAWING

FIG. 10 is a view similar to FIG. 8 illustrating the elements of the operating cassette when the rack plate has been moved to an unlocked position relative to the actuator; and FIG. 11 is a view similar to FIG. 10 illustrating the elements of the outside operating cassette when the latchbolt has been fully retracted.

DESCRIPTION OF THE PREFERRED EMBODIMENT

Figure 1:
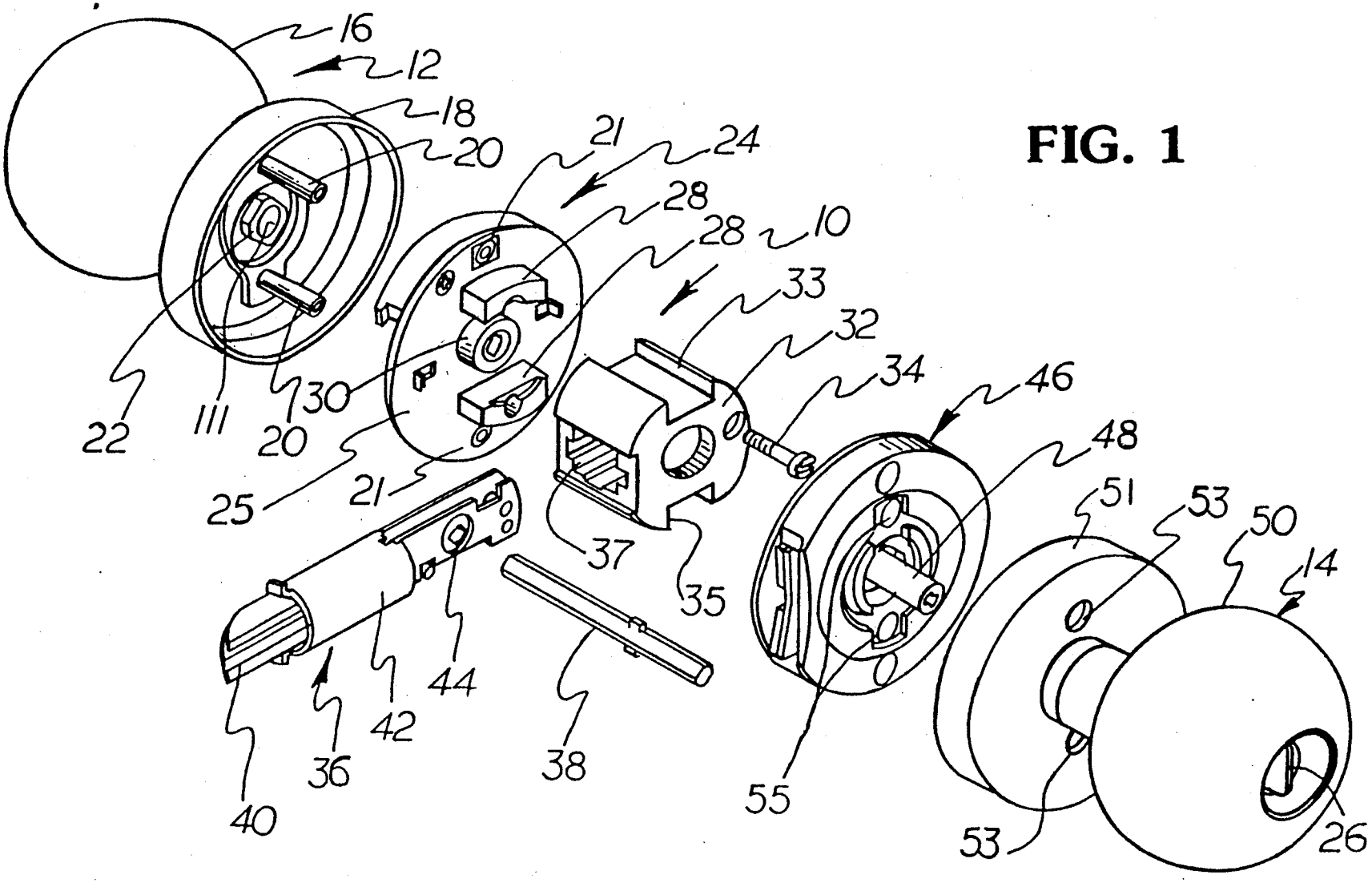
FIG. 1 is a perspective exploded view showing various sub-assemblies of the lockset embodying the present invention.

Referring to the various Figures of the drawing, and in particular to FIGS. 1 through 4, lockset mechanism 10 of the present invention is shown mounted in a door and includes an outside hand operated assembly 12 and an inside hand operated assembly 14, which in the preferred embodiment are an outside knob 16 and an inside knob 50. The outside and inside knobs 16 and 50 are used to retract a latchbolt 40 of the latchbolt assembly 36 from a strike box and strike plate mounted on a door jamb, of a door in conventional fashion. According to the embodiment illustrated herein, the outside hand operated assembly may be provided with a key operated lock cylinder 23 mounted within the outside knob 16. Inside hand operating assembly 14 of the lockset may be provided with a turn button 26 mounted within inside knob 50. Lockset cylinder 23 and turn button 26 may be used to move latchbolt 40 between its extended deadbolt and latching positions as described in U.S. Pat. No. 4,594,864 issued June 17, 1986, in the name of LeRoy Hart and assigned to the same assignee as is the present application.

Figure 2:
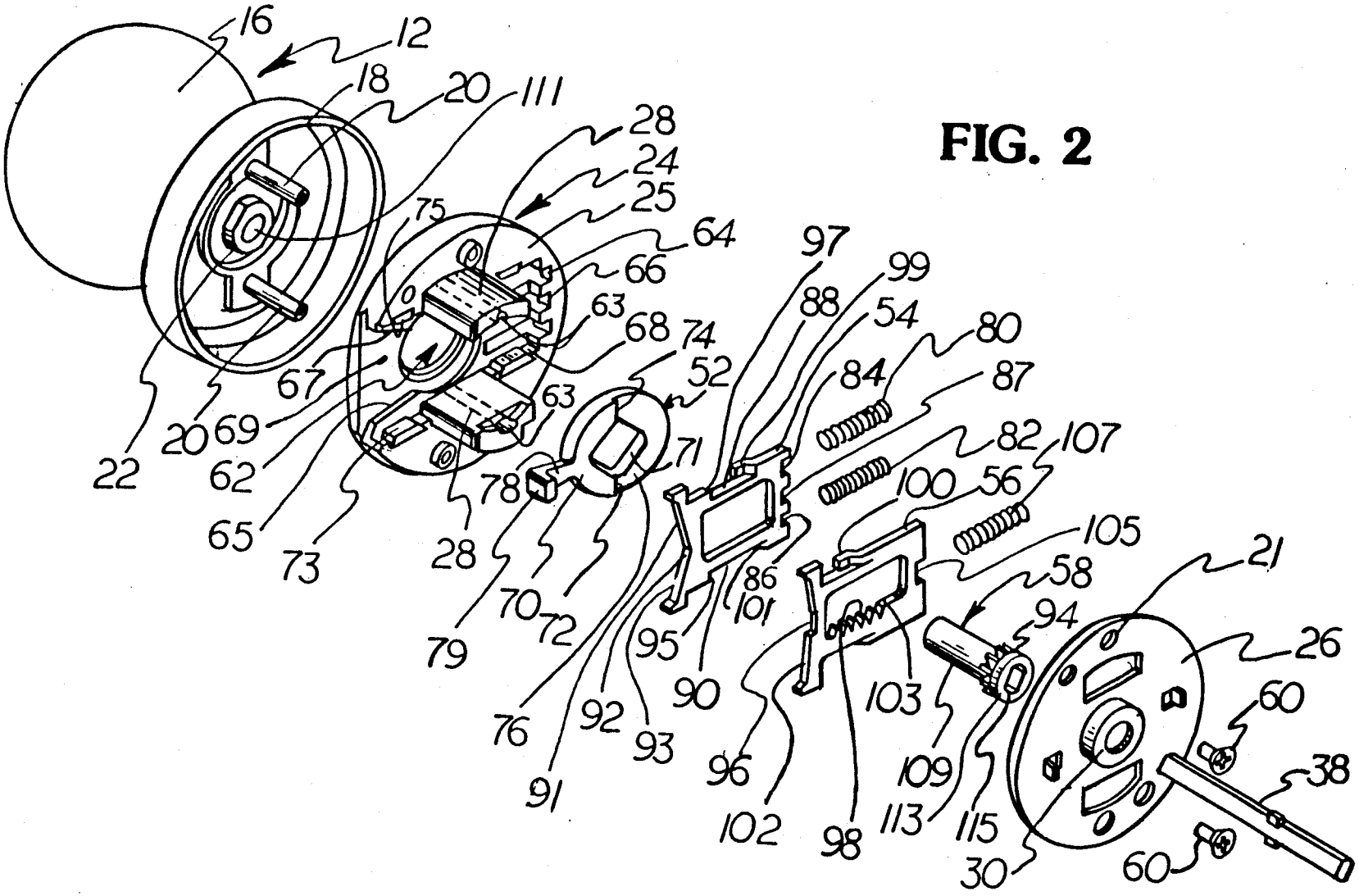
FIG. 2 is a perspective exploded view of the outside actuating assembly of the lockset embodying the present invention.
Figure 3:
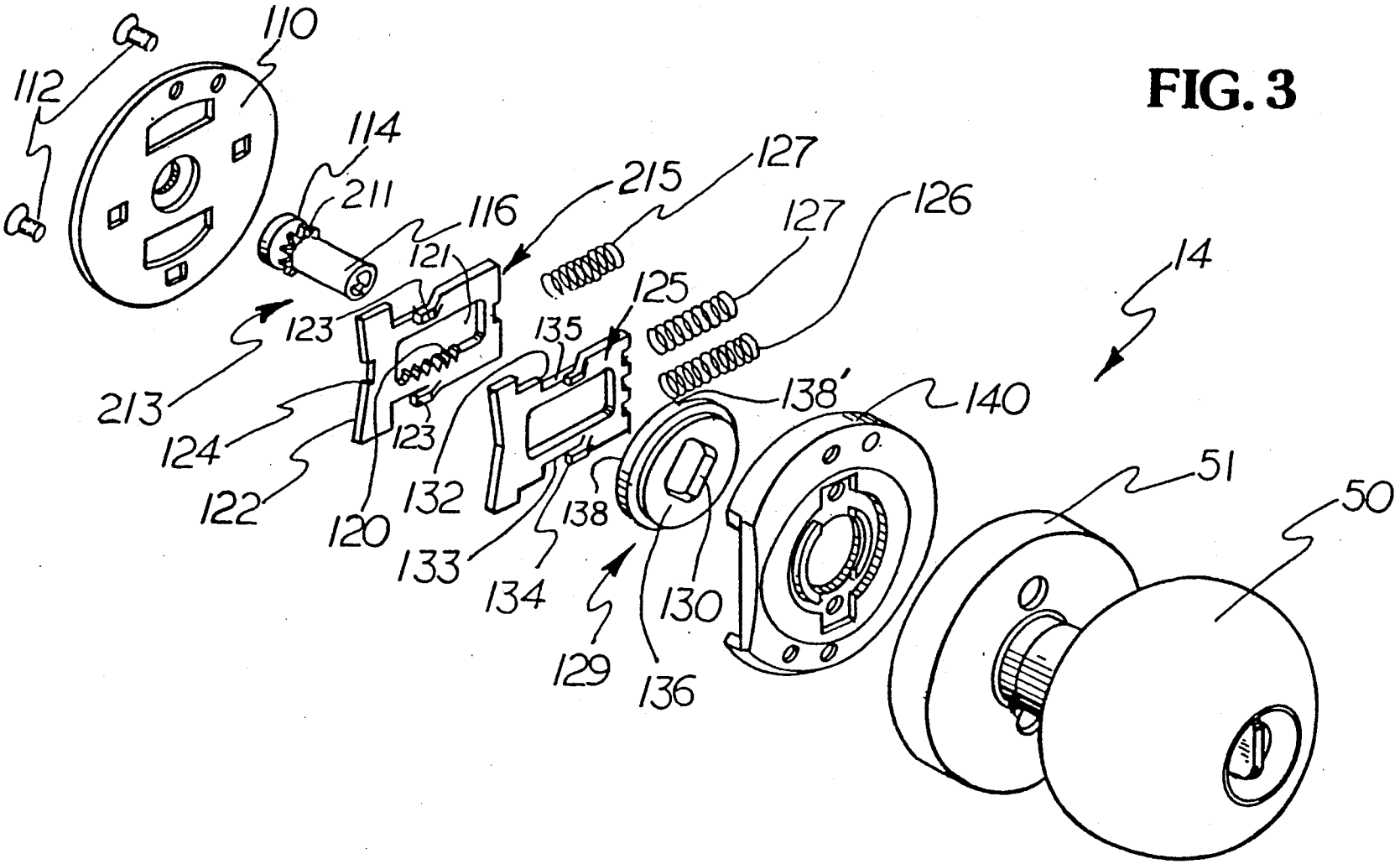
FIG. 3 is a perspective exploded view of the inside actuating assembly of the lockset embodying the present invention.
Figure 4:
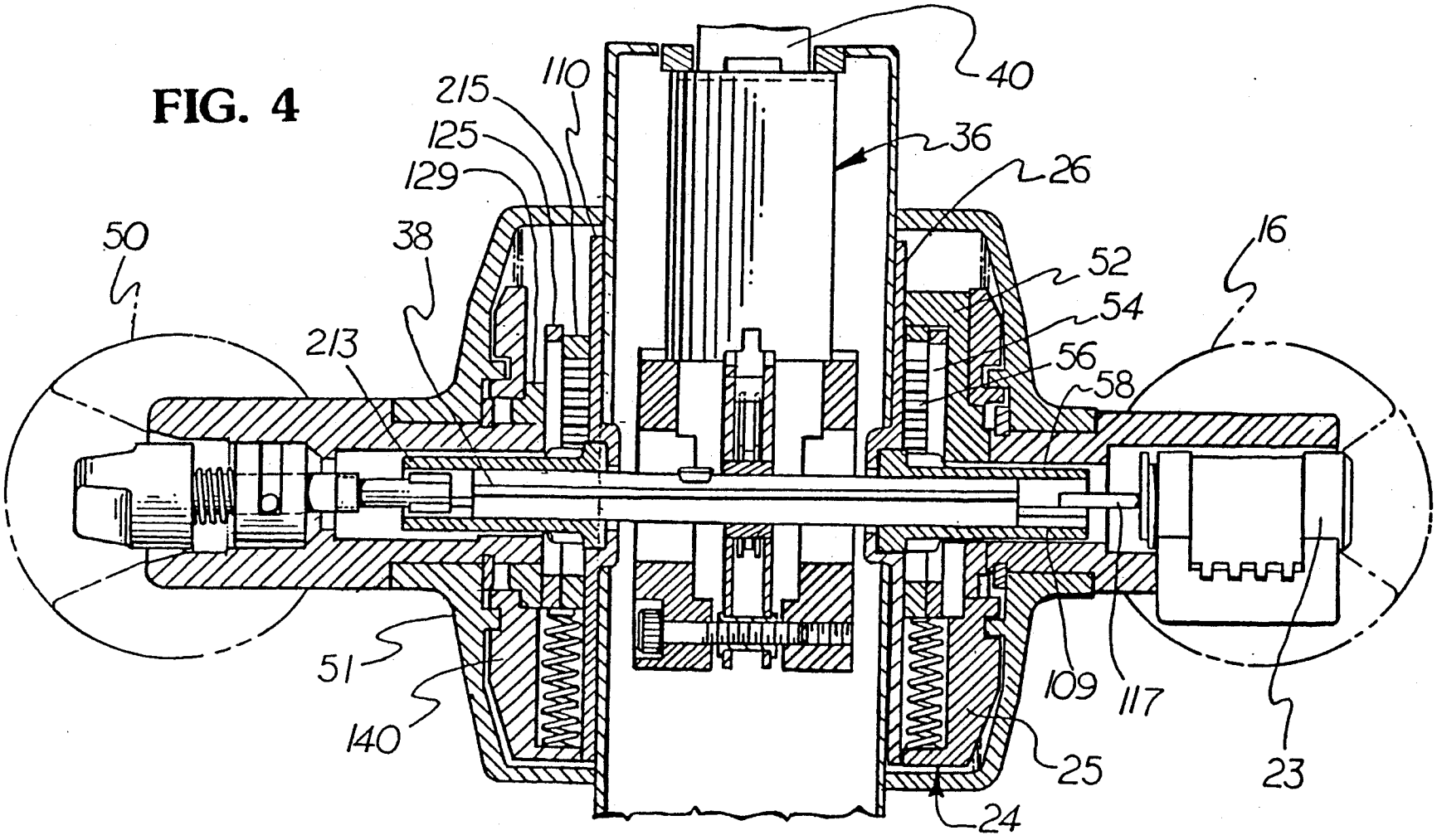
FIG. 4 is a longitudinal sectional view of the lockset.

Referring now primarily to FIGS. 2 through 4, outside operating assembly 12 includes outside knob 16 which is rotatably mounted within an outside rose 18 and includes a generally square-shaped projection 22 extending into outside rose 18. Positioned within outside rose 18 is outside operating cassette 24 having upper and lower ear-like projections 28 extending axially therefrom which fit into suitable grooves 33 and 35 on the outer surface of a latchbolt assembly holder 32. Holder 32 is positioned within the door. Latchbolt holder assembly 32 mounts latchbolt assembly 36 which contains a latchbolt 40 and includes a suitable slot 37 into which latchbolt assembly 36 may be inserted.

Inside operating assembly 14 includes inside knob 50 pivotally mounted within an inside rose 51. Inside operating cassette 46 is mounted within inside rose 51 and likewise includes upper and lower ear-like projections (not shown) extending axially into grooves 33 and 35 on latchbolt holder assembly 32. Spindle 38 extends through latchbolt assembly 36 at a connecting location and between inside and outside operating cassettes 24 and 46 in a direction perpendicular to the axis of movement of latchbolt 40.

Outside rose 18 to which outside knob 16 is attached includes upper and lower internally threaded posts 20 extending in a direction perpendicular to the axis to movement of latchbolt 40. When outside rose 18 is mounted over outside operating cassette 24, posts 20 extend into openings 63 in outside operating cassette 24. As illustrated in FIG. 3, inside rose 51 has upper and lower openings 53 which align with openings 55 in inside operating cassette 46 when inside rose 51 is mounted thereon. Suitable fastening means such as screws extend through openings 53, 55 in the inside rose and inside operating cassette into threaded engagement with posts 20 on outside rose 18.

Latchbolt assembly 36 is positively mounted to latchbolt assembly holder 32 by means of screw 34 and the inside and outside operating cassettes are held in proper alignment with holder 32 by means of projections 28 extending within grooves 33 and 35. This helps ensure proper alignment of the various components for insertion of spindle 38.

Referring primarily to FIG. 2, outside operating cassette 24 includes housing 25 having a central opening 62 into which projection 22 of outside knob 16 extends. The inside of housing 25 includes spaced wall portions 65 and 67 extending forwardly from opening 62 in the direction of the extension of latchbolt 40. Wall portions 65 and 67 taper outwardly and away from each other forming a V-shaped outer guideway 69. Housing 25 also has a second set of opposed wall portions 73 and 75 spaced axially inwardly of wall portions 65 and 67. Wall portions 73 and 75 form upper and lower stop shoulders. The housing also includes grooves 64, 66 and 68.

Actuating member 52 is mounted in guideway 69. Actuating member 52 includes a boss 76 (FIG. 5) mounted into opening 62 in housing 25 and includes a generally square-shaped opening 71 for receiving the generally square-shaped projection 22 of outside knob 16. Boss 76 (FIG. 5) includes an inwardly extending raised cam surface 70 which extends approximately 180 degrees about the circumference of the generally annular boss. Actuating member 52 further includes a reduced elongated tail portion 78 which extends from the boss portion 76 and is positioned within the V-shaped guideway 69. The forward end of tail portion 78 is provided with a cam surface 79 extending inwardly past the plane of the inner surface of tail portion 78. Vertically extending surfaces 72 and 74 define the end of cam surface 70.

Spring plate 54 is mounted within housing 25 of outside operating cassette 24 in overlapping relationship with actuating member 52. At its forward end spring plate 54 includes spaced fingers 91 and 93 defining therebetween a modified V-shaped cam surface 92 to be engaged by cam surface 79 of actuator 52. The spring plate is biased forwardly in the direction of the extension of latchbolt 40 into engagement with the inside surface of surface 79 by means of two springs 80 and 82, which are positioned in grooves 64 and 68 in housing 25.

Figure 5:
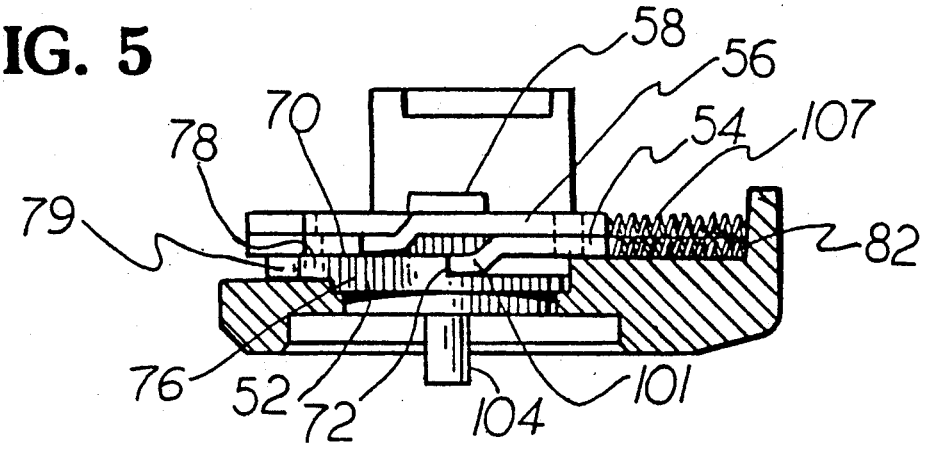
FIG. 5 is a plan view, partially in section, illustrating the position of the elements of the outside operating cassette when the lockset is in a deadbolt position.
Figure 6:
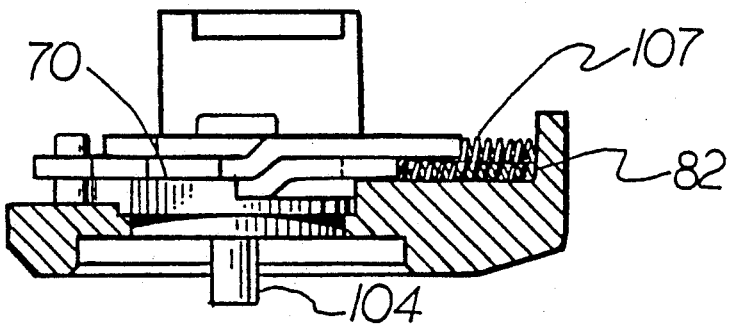
FIG. 6 is a view similar to that illustrated in FIG. 5 illustrating the components of the outside operating cassette in a second operating position whereat the deadbolt is partially retracted.
Figure 7:
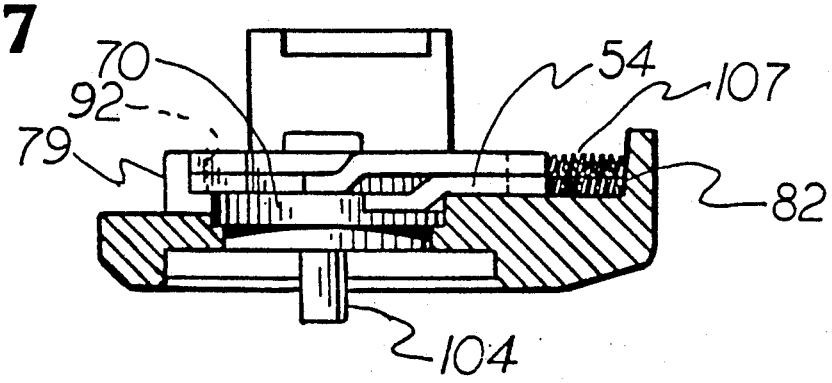
FIG. 7 is a view similar to FIGS. 5 and 6 illustrating the components of the outside operating cassette in a third operating position whereat the latchbolt of the lockset has been fully retracted.

Spring plate 54 has cut-out portions 88 and 90 in its upper and lower side edges forming tab engaging surfaces 95 and 97. Cut-out portions 88 and 90 further include inwardly extending ears 99 and 101 which as illustrated in FIGS. 5, 6, and 7 lie in the same axial plane as cam surface 70 to thereby engage surfaces 72 and 74 of actuator member 52. Ears 99 and 101 are generally aligned with and vertically spaced about the longitudinal axis of spindle 38. Likewise surfaces 72 and 74 are generally aligned with and spaced about the longitudinal axis of spindle 38.

Figure 8:
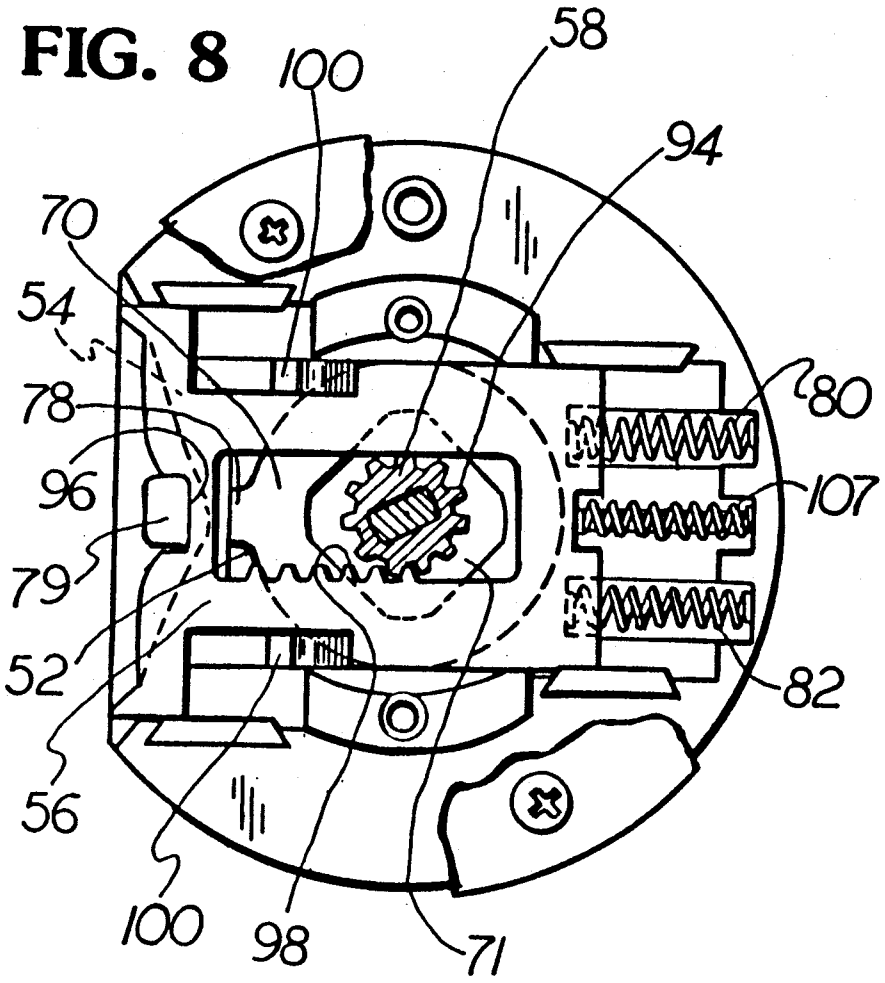
FIG. 8 is an elevation view of the outside operating cassette with the front cover removed, illustrating the components when the lockset is in its deadbolt position.

A generally flat rack plate 56 is mounted within housing 25 in overlapping relationship with spring plate 54. The upper and lower edges of rack plate 56 have outwardly extending tab portions 100 extending outwardly into cut-out portions 88 and 90 in spring plate 54 to be engaged by tab engaging surfaces 95 and 97. Rack plate 56 has a generally rectangular internal cut out 103, with the longer sides extending parallel to the axis of latchbolt assembly 36. Gear teeth 98 are provided on rack plate 56 adjacent one of the longer sides of cut-out 103 to form a rack which extends parallel to the axis of latchbolt assembly 36. The forward end 102 of rack 56 is provided with a notch 96 into which the leading edge of surface 79 of actuator 52 extends when the rack member is in its forward position as shown in FIG. 8 to prevent rotation of actuating member 52. Rack plate 56 is biased into its forward position by spring 107 positioned in a groove 66 formed in housing 25 and the rear surface of notch 105 formed in the back wall of rack plate 56.

A pinion member 58 extends perpendicular to the axis of latchbolt 36 and is mounted within outer operating cassette 24. Member 58 includes a set of gear teeth 94 which are in mating engagement with gear teeth 98 on rack plate 56. Pinion member 58 includes tubular extension 109 which extends through spring plate 54, actuating member 52, and housing 25 into an opening 111 defined by projection 22.

Pinion member 58 includes a head portion 113 which is contained within the inside of boss 30 extending inwardly on cover member 26. Boss 30 provides a bearing surface for head portion 113. Head portion 113 of pinion member 58 has a generally rectangular slot 115 therein of a mating cross-section with that of spindle 38 which extends therethrough. As shown in FIG. 4, tubular extension 109 is engagable by a drive member 117 connected to lock cylinder 23 in the outside knob 16 to rotate pinion member 58 between its unlocked and dead bolt positions.

In accordance with the above described arrangement, actuating member 52 has pivotal movement about the axis of spindle 38 and is operably attached to outside knob 16. Spring plate 54 and rack plate 56 are mounted within housing 25 for rectilinear motion in a direction parallel to the motion of latchbolt 40 of latchbolt assembly 36. Cover member 26 for outside operating cassette 24 is provided with suitable cut-out portions through which projections 28 extend to contain the operative parts of outside operating assembly 12 as a unit. The cover member is attached to housing 25 by means such as screws 60 which extend through cover member 26 into threaded bores formed within the housing.

Referring primarily to FIG. 3, inside operating assembly 14 includes inside rose 51 and inside knob 50 attached thereto by suitable conventional means. Inside operating cassette 46 includes basically the same elements and is constructed similar to that of the outside operating cassette 24 which has been described previously. Accordingly, the description of the various components of inside operating cassette 46 will be relatively brief, except that the differences between it and the outside operating cassette shall be pointed out in more explicit detail below.

Inside operating assembly 14 includes an inside housing 140 having projections extending therefrom which are identical to projections 28 extending from housing 25. An actuating member 129 is mounted for pivotal movement in housing 140. Inside actuating member 129 includes a central generally square-shaped opening 130 into which a square-shaped projection (not shown) of the inside knob 50 projects in a manner similar to the extension of projection 22 into square-shaped opening 71 of actuator 52 of outside operating assembly 12. Actuator 129 further includes a boss 136 having a raised cam surface 138 extending approximately 180 degrees about the circumference of the boss. In comparing actuator 129 to actuator 52, it will be noted that actuator 129 does not include tail portion 78 for a reason which shall be clearly described hereinafter.

Spring plate 125 is mounted in a suitable guide way in the inside housing 140. As in the case of the outside operating mechanism, spring plate 125 is spring biased forwardly by spring members 126, 127. Spring plate 125 also includes cut out portions 133 and 135 in the lower and top edges forming tab engaging surfaces 132. Cut out portions 133 and 135 further include inwardly extending ears 134 which lie in the same axial plane as cam surface 138 of actuator 129 to thereby engage surfaces 138' (only one shown) which define the two ends of cam surface 138. Ears 134 are generally aligned with, and vertically spaced about the longitudinal axis of spindle 38. Likewise, surfaces 138' are generally aligned with, and spaced about, the longitudinal axis of spindle 38.

Inside operating cassette 46 also includes a generally flat rack plate 215 mounted within housing 140 in overlapping relationship with spring plate 125. Rack plate 215 includes gear teeth 120, provided adjacent rectangular cut out 121. Rack plate 215 is spring biased forwardly by spring member 127. Rack plate 215 includes outwardly extending tabs 123 extending into cut out portions 133 and 135 in a position to be engaged by tab engaging portions 132 of spring plate 125. Pinion member 213 includes gear teeth 211 thereon in mating, engagement with gear teeth 120 on rack plate 215. Pinion member 213 also includes a tubular extension 116 which extends through inside operating cassette 14 into an opening in inside knob 50. Pinion member 213 further includes a head portion 114 contained within a suitable boss formed in inside cover 110. Cover 110 is attached to housing 140 by means of screws 112, or the like. Head portion 114 of pinion member 213 also includes a slot through which one end of spindle 38 extends.

Referring specifically to FIGS. 5–10, the manner in which the new actuator functions with respect to the spring and rack plates to achieve movement of the latchbolt shall now be more fully described. In particular, FIGS. 5–10 illustrate outside hand operator 12.

Figure 9:
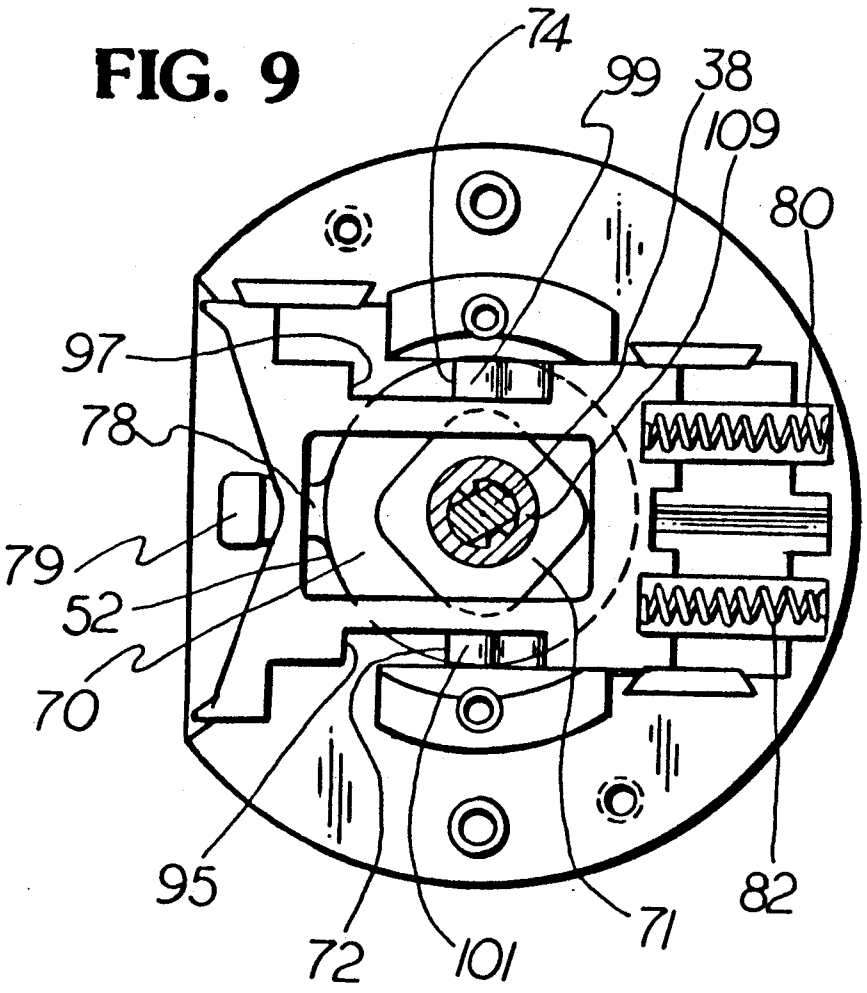
FIG. 9 is a view similar to FIG. 8 with the rack plate removed.

Referring specifically to FIGS. 5, 8, and 9, the components of outside hand operator 12 are illustrated in their fully extended latchbolt position. In such position, spring plate 54 and rack plate 56 are biased to the left by springs 80, 82, and 107. Cam surface 79 extends within notch 96 of rack plate 56 to prevent rotation of actuator 52 and thus to maintain the latch in its fully extended locked position. In this position, rotation of knob 16 is prevented.

It should be noted that ends 72, 74 of cam surface 70 are, when the latchbolt is in its fully extended position, in generally vertical alignment with and spaced equidistant vertically above and below spindle 38. In this position, tail portion 78 lies in a generally horizontal plane relative to spindle 38, and is essentially parallel to latchbolt 40.

It should be further observed that inwardly extending ears 99 and 101 of spring plate 54 engage surfaces 72 and 74 of cam surface 70. It should be further noted that tab portions 100 of rack plate 56 engage surfaces 95 and 97 of spring plate 54.

Initially, when it is desired to unlock the latchbolt, a key is inserted into the keyway of lock cylinder 23 to rotate the lock cylinder, tubular extension 109 and drive member 117 to simultaneously rotate spindle 38. The foregoing results in rotation of pinion member 58, which through engagement of gear teeth 94 thereof with gear teeth 98 of rack plate 56 results in movement of the rack plate toward the right. Such movement of the rack plate separates cam surface 79 from notch 96.

Thereafter, if it is desired to retract the latchbolt, knob 16 may be rotated in either clockwise or counter-clockwise directions. The foregoing result in concomitant rotation of actuator 52 through engagement of square shaped opening 71 thereof with generally square-shaped projection 22.

As actuator 52 rotates in either the clockwise or counter-clockwise directions, either one of the ends 72 or 74 of cam surface 70 provides a force through engagement with one of the inwardly extending ears 99 or 101 to move spring plate 54 to the right. Such movement of the spring plate brings tab engaging surfaces 95 and 97 thereof into re-engagement with outwardly extending tab portions 100 of rack plate 56. Thereafter, continued movement of spring plate 54 to the right results in concomitant movement of the rack plate to the right.

Movement of the rack plate to the right, as viewed in FIGS. 5–7 and 11 results in rotation of pinion member 58 through engagement of gear teeth 94 with gear teeth 98. Rotation of the pinion member results in rotation of spindle 38 which then functions to retract latchbolt 40 in a conventional manner.

It should be observed that as rack plate 56 and spring plate 54 are moved to the right, springs 107, 80 and 82 are compressed whereby the resistive force acting to prevent further movement of the spring and rack plates increases.

FIG. 11 illustrates the position of the various components of cassette 24 when knob 16 has been rotated to fully retract latchbolt 40. In this position, it will be observed that cam surface 79 is in engagement with the top portion of end 102 of rack plate 56. Likewise, as illustrated in FIG. 7, cam surface 79 is in engagement with the upper portion of cam surface 92 of spring plate 54. In essence, as the actuator is rotating, cam surface 79 is brought into engagement with the opposing faces of the rack and spring plates whereby the retractive force provided by cam surface 79 is additive to the retractive force provided by cam surface 70. The additive retractive forces overcome the resistive forces of the biasing springs, frictional forces and all internal forces acting to prevent retraction of the latchbolt.

The main force provided by actuator 52 to retract the latch is generated through cam surface 70. Such force is generally provided about the longitudinal centerline of the lockset which results in proportionally more of such force being available to retract latchbolt 40 when compared to the actuator of the prior art as disclosed in U.S. Pat. No. 4,594,864. The magnitude of the effective retractive force produced by the actuator is inversely proportional to the radial distance from the longitudinal centerline at which the force is applied; that is, as the radial distance increases, the magnitude of the effective force decreases. The actuator of the present invention substantially applies such force along the longitudinal centerline of the lockset.

While operation of outside hand operated assembly 12 has been described in detail, it should be understood that the operation of inside hand operated assembly 14 is identical with the following exception.

As noted previously, actuator 129 does not include a tail portion. The absence of the locking arrangement produced by tail portion 78 and notch 96 of outside hand operating assembly 12 ensures that the inside hand operator will at all times be capable of immediately retracting latchbolt 40. Accordingly, the retractive force developed by actuator 129 will only be generated by cam surface 138. However, as the cam surface of actuator 129 is identical in function and relative location to cam surface 70 of outside actuator 52, the retractive force developed by cam surface 138 is of a sufficient magnitude to retract latchbolt 40.

While FIGS. 1–11 illustrate knob-type devices being used on both the outside and inside hand-operators, it should be understood that the actuator of the present invention may be used with other types of operators such as exit devices of the type disclosed in U.S. Pat. No. 3,877,262.

While a preferred embodiment of the present invention has been described and illustrated, the invention should not be limited thereto, but may be otherwise embodied within the scope of the following claims.

We claim:

1. A lockset for a door comprising:

a latchbolt assembly having a latchbolt movable between a partially extended latching position, a fully extended dead-bolt position and a retracted position;

a spindle extending through said latchbolt assembly in a direction transverse of the direction of movement of said latchbolt;

means connecting said spindle to said latchbolt at a connecting location on said spindle for moving said latchbolt between its positions upon rotation of said spindle;

a hand operator;

a first plate located for linear sliding movement adjacent said spindle and primarily in a first plane spaced from said latchbolt assembly and said connecting location;

a second plate located for sliding movement relative to said first plate adjacent said spindle and primarily in a second plane spaced from said latchbolt assembly and said connecting location;

an actuator member mounted for movement adjacent said spindle and having an actuator surface in a third plane spaced from said latchbolt assembly and said connecting location;

means responsive to the operation of said hand operator for moving said actuator member;

an ear formed on said second plate and located in said third plane in position for engagement with said actuator surface upon movement of said actuator member to facilitate movement of said second plate;

a tab extending from said first plate and located in said second plane;

a tab-engaging surface formed on said second plate and located in said second plane in position for engagement with said tab upon movement of said second plate to facilitate movement of said first plate; and means formed independently of said first plate and coupling said first plate to said spindle for rotating said spindle upon movement of said first plate thereby to move said latchbolt within the latchbolt assembly.

2. A lockset in accordance with claim 1 wherein the hand operator is a rotatable knob.

3. A lockset in accordance with claim 2 wherein the radial center of the knob is substantially concentric with the radial center of said actuator member.

4. A lockset in accordance with claim 1, which further comprises:

locking means located in said hand operator for selectively precluding movement of the latchbolt.

5. A lockset in accordance with claim 4, which further comprises:

means for coupling said rotating means to said locking means to prevent movement of said rotating means when said locking means is in a locked state and to permit movement of said rotating means when said locking means is in an unlocked state.

6. A lockset in accordance with claim 1 wherein said moving means includes:

an opening formed in said actuator member of prescribed configuration; and a projection extending from said hand operator into said opening and having an exterior configuration which mates with the prescribed configuration of said opening.

7. A lockset in accordance with claim 1 wherein said first, second and third planes are successively located from the connecting location on said spindle and between said latchbolt assembly and said hand operator.

8. A lockset in accordance with claim 1 wherein said rotating means includes:

an element mounted for rotary movement with said spindle;

a pinion having gear teeth attached to said element for rotary movement therewith; and gear teeth formed on said first plate and enmeshed with teeth of said pinion whereby, upon movement of said first plate, said pinion and said element are rotated said spindle and thereby move said latch-bolt.

9. A lockset in accordance with claim 1 wherein said ear is a first ear, said tab is a first tab, said tab-engaging surface is a first tab-engaging surface and said actuator surface is a first actuator surface all of which are located spatially from a first side of said spindle, and which further comprises:

a second ear formed on said second plate and located in said third plane spatially from a second side of said spindle which is opposite the first side thereof;

a second tab formed on said first plate and located in said second plane spatially from said second side of said spindle;

a second tab-engaging surface formed on said second plate and located in said second plane spatially from said second side of said spindle; and said actuator member being formed with a second actuator surface located in said third plane spatially from said second side of said spindle.

10. A lockset in accordance with claim 1, which further comprises:

means formed on said actuator member and engageable with said second plate for assisting in the facilitation of movement of said second plate upon movement of said actuator member.

11. A lockset in accordance with claim 1, which further comprises:

means formed on said actuator member and engageable with said first plate and said second plate for assisting in the facilitation of movement of said first plate and said second plate upon movement of said actuator member.

12. A lockset in accordance with claim 1, which further comprises:

a locking element formed on said actuator member;

means formed on said first plate for holding said locking element to preclude movement of said actuator member.

13. A lockset in accordance with claim 12, which further comprises:

means for selectively operating said rotating means independently of said first plate to move said first plate and said holding means to release said locking element and thereby permit movement of said actuator member upon operation of said hand operator.

* * * * *